US005156018A

United States Patent [19]

Kobayashi et al.

[11] Patent Number: 5,156,018

[45] Date of Patent: Oct. 20, 1992

[54] CONDENSATE WATER DISPOSAL ARRANGEMENT FOR UNIT-TYPE AIR CONDITIONER

[75] Inventors: Tatuhiro Kobayashi, Otsu; Mitsuo Nakanuma; Hideki Matsumi, both of Shiga, all of Japan

[73] Assignee: Matsushita Electric Industrial Co., Ltd., Osaka, Japan

[21] Appl. No.: 763,268

[22] Filed: Sep. 20, 1991

[30] Foreign Application Priority Data

Sep. 28, 1990 [JP] Japan ..... 2-260957

[51] Int. Cl.[5] ..... F25B 47/00

[52] U.S. Cl. ..... 62/280; 62/285

[58] Field of Search ..... 62/280, 272, 285, 42, 62/288, 289

[56] References Cited

U.S. PATENT DOCUMENTS

| | | | |
|---|---|---|---|
| 2,349,059 | 5/1944 | Terry et al. | 62/280 |
| 3,811,293 | 5/1974 | Flynn | 62/280 |
| 4,067,206 | 1/1978 | Smith | 62/280 |

*Primary Examiner*—Albert J. Makay
*Assistant Examiner*—William C. Doerrler
*Attorney, Agent, or Firm*—Stevens, Davis, Miller & Mosher

[57] ABSTRACT

A unit-type air conditioner has an out-door portion which has an out-door heat-exchanger, an out-door fan opposing the out-door heat exchanger and an air guider having an orifice defining the passage of air from the out-door fan and the out-door heat exchanger. The center of the circle of a slinger ring attached to the out-door fan is slightly offset from the center of the circle of the orifice such that the circle of the slinger ring is offset from the center of the orifice in the direction in which the slinger ring scoops condensate water generated in the air conditioner. Part of the condensate water scooped by the slinger ring is sprayed to the out-door heat exchanger so as to be evaporated by the heat generated in the heat-exchanger, while the remaining part of the condensate water collides with the wall of the orifice so as to be returned to a drain pan. Consequently, undesirable springing of condensate wall from out-door air suction openings is avoided.

2 Claims, 3 Drawing Sheets

CONDENSATE WATER DISPOSAL ARRANGEMENT FOR UNIT-TYPE AIR CONDITIONER

BACKGROUND OF THE INVENTION

The present invention relates to an arrangement for disposing of condensate water in a unit-type air conditioner which has a fan equipped with a slinger ring.

FIG. 1 shows a known condensate water disposal arrangement adopted in a unit-type air conditioner. As will be seen from the Figure, an air guider 20 has an orifice 21 and a flange 24 which has the same diameter as the orifice 21 and a predetermined axial length and which projects from the entire circumference of the orifice 21 in the downstream direction as viewed in the direction of flow of the air.

In addition, an anti-spray plate 25 is fixed by, for example, welding so as to contact the inner surface of the flange 24 and so as to project a predetermined length from the air guider 20 in the upstream direction. The anti-spray plate 25 is inwardly bent at its upstream lower end portion from the circumference of the orifice 21 so as to provide a waterproof flange 26 which is fixed, by for example, welding. Suitable seal members also are provided at portions where water tends to be sprayed.

The anti-spray plate 25 is effective in preventing spraying of condensate water which is agitated and presence of the anti-spray plate 25, however, increases the resistance to the flow of air at the upstream side of the fan 22 so as to reduce air flow rate and, at the same time, raises the level of noise generated during operation of the air conditioner.

The waterproof flange 26 projects inward from the circumference of the orifice 21 at the lower end portion of the anti-spray plate 25. The effect of the waterproof plate 26, however, is reduced due to the fact that the fan 22 splashes condensate water which was spouted into the fan space through the lower portion of the orifice 21 as a result of generation of a difference in the air pressure between the downstream space, i.e., the space between the air guider 20 and an outdoor heat exchanger 28, and the upstream space upstream of the air guider 20.

Furthermore, this known condensate water disposal device employs a large number of parts and, hence, requires a large number of steps of the assembly process, resulting in an inferior precision of assembly and raised cost of production.

SUMMARY OF THE INVENTION

Accordingly, an object of the present invention is to provide an arrangement for disposing condensate water which can effectively prevent scattering of condensate water scooped by a slinger ring on a fan, without requiring any specific part to be attached to an air guider, thereby obviating the above-described problems of the prior art.

Another object of the present invention is to provide a condensate water disposal arrangement in which no specific part is attached to the air guider so that the number of parts is reduced to enable a remarkable reduction in the number of steps of the assembly process, thereby enhancing assembly precision and reducing the cost of production.

According to the present invention, there is provided a condensate water disposal device in which the center of the slinger ring attached to the fan is offset from the center of the orifice of the air guider such that the circle of the slinger ring is deviated from the circle of the orifice of the air guider in the direction in which the condensate water is scooped by the slinger ring.

In a specific form of the present invention, the end of the orifice of the air guider is slightly bent inward at the region where the circle of the slinger ring is outwardly deviated from the circle of the orifice.

According to the invention, it is possible to prevent scattering of condensate water without requiring any specific part to be attached to the air guider, by virtue of the offset of the center of the slinger ring from the center of the orifice.

In addition, slight inward bending of the end of the orifice effectively prevents backward rushing of condensate water into the fan space which may otherwise be caused by the pressure differential of the air between the upstream and downstream space.

DESCRIPTION OF THE PREFERRED EMBODIMENT

Figure 1:
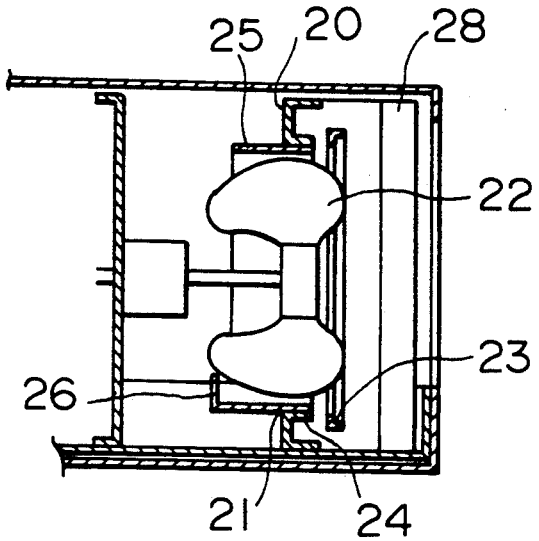
FIG. 1 PRIOR ART
FIG. 1 is a cross-sectional view of the outdoor portion of a known unit-type air conditioner.
Figure 2:
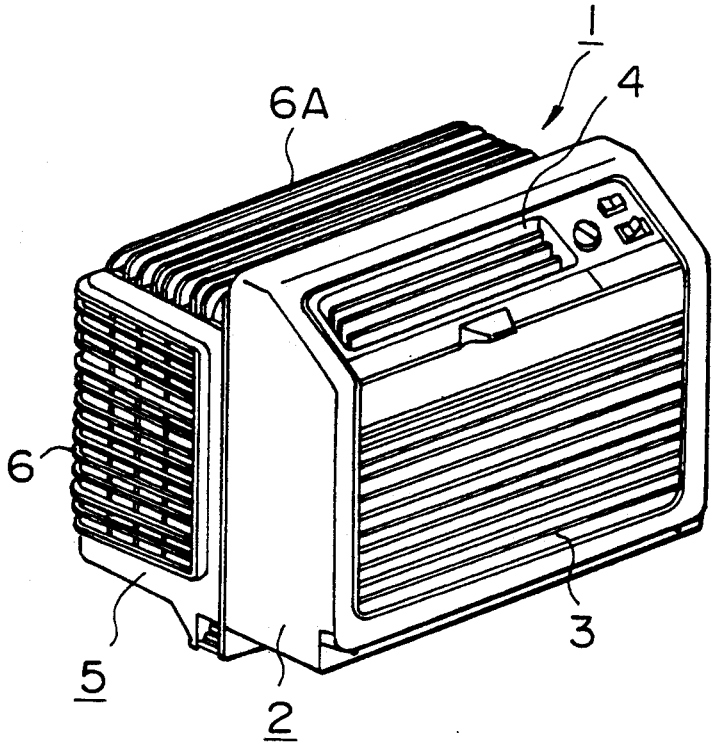
FIG. 2 is a perspective view of a unit-type air conditioner incorporating an arrangement of the invention for disposing condensate water, as viewed from the in-door side of the air conditioner.
Figure 3:
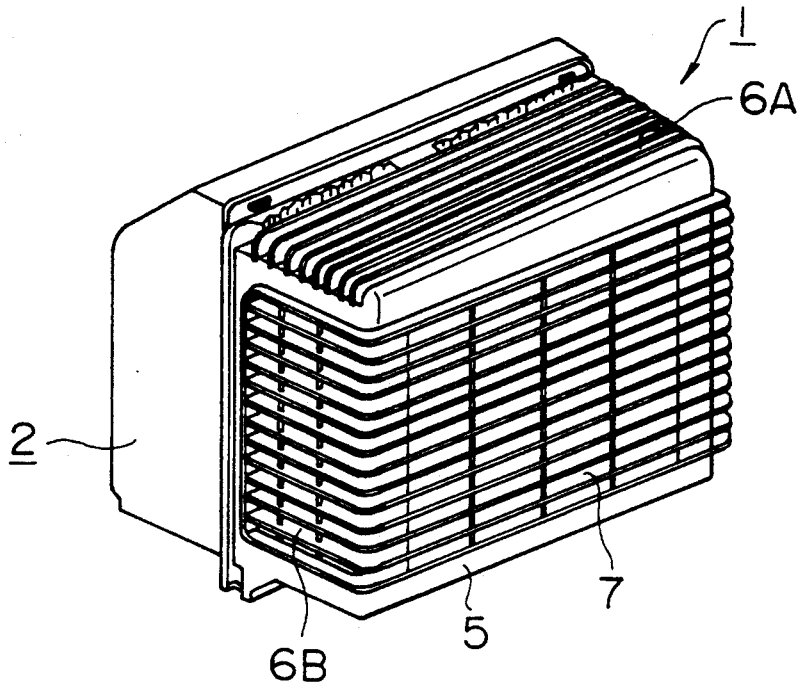
FIG. 3 is a perspective view of the air conditioner of FIG. 2 as viewed from the out-door side of the air conditioner.
Figure 4:
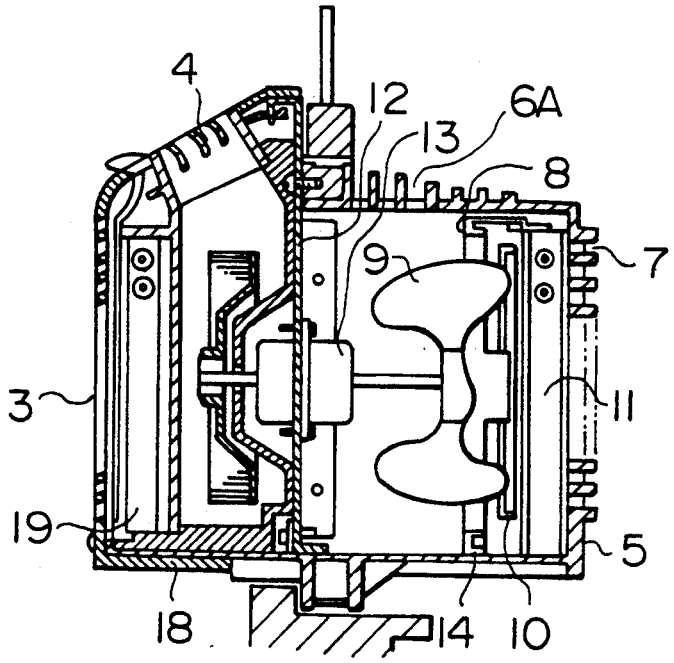
FIG. 4 is a sectional side elevational view of the unit-type air conditioner taken at a vertical plane.

Embodiments of the present invention will be described with reference to FIGS. 2 to 6B.

A unit-type air conditioner generally denoted by 1 incorporates components of a refrigeration cycle known per se. An in-door grille 2 is provided on the front side of the air conditioner 1. Air in a room is sucked through an in-door suction opening 3 and is cooled by an in-door heat exchanger 19. The cooled air is then blown into the room through an indoor air outlet 4. Water content of the air is condensed into liquid phase as the air is cooled by the in-door heat exchanger 19. The condensate water is pooled in a drain pan formed by a frame 5 which also serves as the bottom of a housing.

The out-door portion of the air conditioner 1 is provided at its both side portions and at its top portion with side and top air suction openings 6, 6A and 6B. The out-door portion also includes a fan 9 for inducing air through the out-door suction openings 6A and 6B and an out-door heat exchanger 11, and an air guider 8 through which the induced air is supplied to the out-door heat exchanger 11. The air exiting the out-door heat-exchanger 11 is blown to the exterior through an out-door air outlet 7.

During the operation of the air conditioner, the condensate water stagnant in the above-mentioned drain pan is agitated and scooped by a slinger ring 10 which is fixed to the blades of the fan 9 so as to be sprayed to and evaporated by the out-door heat exchanger 11.

The frame 5 serving as the bottom of the housing has a box-like construction having a bulkhead 12 which serves as a partition for dividing the space inside the housing into an in-door side space and an out-door side space. The fan 9 is attached to the shaft of a fan motor 13 which is secured to the bulk head 12.

Figure 5:
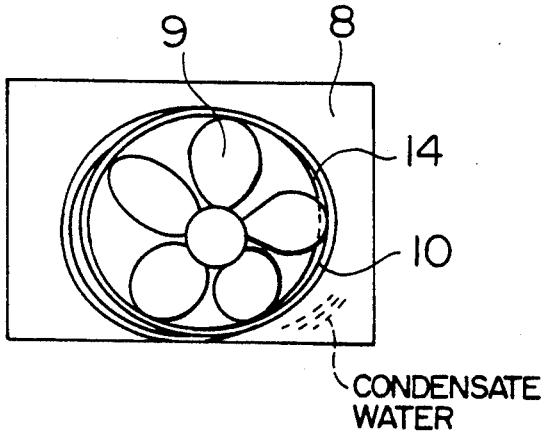
FIG. 5 is a front elevational view of the unit-type air conditioner illustrating the manner in which the center of the slinger ring is offset from the center of the orifice in accordance with the present invention.

According to the invention, as will be best seen from FIG. 5, the center of the slinger ring 10 is slightly offset from the center of the orifice 14 of the air guider 8 in such a manner that the circle of the clinger ring 10 is deviated from the circle of the orifice 14 outward in the direction in which the condensate water is scooped by the slinger ring 10.

According to the invention, the condensate water scooped by the slinger ring 10 towards the top and both lateral portions of the inner peripheral surface of the air guider 8 collides with the wall defining the orifice 14 so as to be collected again in the drain pan defined by the frame 5, whereby undesirable springing of condensate water from the out-door suction openings 6, 6A, 6B is prevented.

According to this arrangement, the condensate water is disposed of without requiring any specific parts or members to be attached to the air guider. As a consequence, the number of parts required is reduced to enhance the precision of assembly and reducing the cost of preduction.

A second embodiment of the invention will be described with specific reference to FIGS. 6A and 6B. The second embodiment has substantially the same construction as the first embodiment described before. In this embodiment, however, the portion of the orifice 14 of the air guider 8, which is in the region where the circle of the slinger ring 10 is deviated outward from the circle of the orifice 14, is slightly bent as at 14A towards the slinger ring 10 as will be seen from FIGS. 6A and 6B.

In conventional unit-type air conditioner of the kind described, condensate water tends to flow backward together with air which flows backward through the clearance of the blades of the fan 9 and the orifice 14, with the result that the water is scattered outward from the out-door suction openings 6, 6A, 6B.

Figure 6A:
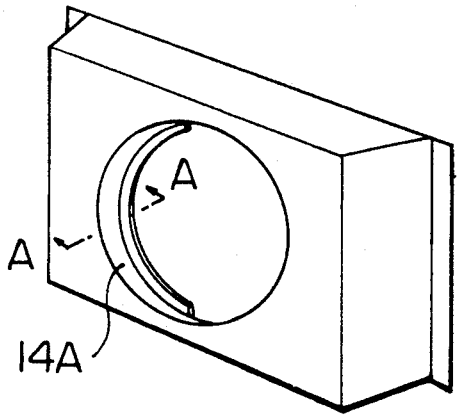
FIG. 6A is a perspective view of an air guider embodying the present invention.
Figure 6B:
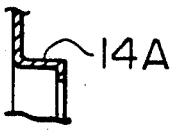
FIG. 6B is an enlarged sectional view taken along the line A—A of FIG. 6A.

In the second embodiment as shown in FIGS. 6A and 6B, however, this problem is eliminated because the bent portion 14A. of the orifice 14 effectively prevents the backward flow of the air.

This not only prevents scattering of condensate water from the out-door suction openings but also reduces resistance to flow of air induced by the fan, whereby the air flow rate is increased to improve the performance of the air conditioner.

Moreover, as in the case of the first embodiment, the number of the parts is decreased to enhance the assembly precision while reducing the cost of production.

As will be understood from the foregoing description, according to the present invention, the center of the circle of the slinger ring is slightly offset from the center of the circle of the orifice in the air guider such that the circle of the slinger ring is slightly deviated from the circle of the orifice in the direction in which the condensate wateris scooped by the slinger ring. Consequently, the condensate water scooped by the slinger ring collides with the wall of the orifice so as to be returned again to the drain pan without being scattered from the air conditioner.

It is to be noted that this remarkable effect can be achieved without requiring any specific part or member to be attached to the air guider, offering an improvement in the assembly precision and a reduction in the production cost.

In a specific form of the invention, a portion of the end of the wall defining the orifice is slightly bent so as to completely eliminate external splashing of the condensate water, while improving the performance of the air conditioner.

What is claimed is:

1. A condensate water disposal arrangement in a unit-type air conditioner of the type having an out-door portion including a housing integral with a frame and defining a drain pan in which condensate water generated in said air conditioner is received, an out-door heat exchanger disposed in said housing, an out-door fan provided with a slinger ring and disposed in said housing so as to oppose said out-door heat exchanger, and an air guider disposed in said housing and having an orifice which defines a passage of air from said out-door fan and said outdoor heat exchanger, said condensate water disposal arrangement characterized in that the center of the circle of said slinger ring is slightly offset from the center of the circle of said orifice such that the circle of said slinger ring is deviated from the circle of said orifice in the direction in which said condensate water is scooped by said slinger ring.

2. A condensate water disposal arrangement according to claim 1, wherein the portion of the wall defining said orifice in the region where said circle of said slinger ring is outside said circle of said orifice is slightly bent radially inward towards said slinger ring.

* * * * *